US009777538B2

(12) United States Patent
McGarian

(10) Patent No.: US 9,777,538 B2
(45) Date of Patent: Oct. 3, 2017

(54) INSULATING COMPONENT

(71) Applicant: Bruce McGarian, Stonehaven (GB)

(72) Inventor: Bruce McGarian, Stonehaven (GB)

( * ) Notice: Subject to any disclaimer, the term of this patent is extended or adjusted under 35 U.S.C. 154(b) by 532 days.

(21) Appl. No.: 14/374,906

(22) PCT Filed: Jan. 24, 2013

(86) PCT No.: PCT/GB2013/050146

§ 371 (c)(1),
(2) Date: Jul. 26, 2014

(87) PCT Pub. No.: WO2013/110935

PCT Pub. Date: Aug. 1, 2013

(65) Prior Publication Data

US 2015/0013963 A1 Jan. 15, 2015

(30) Foreign Application Priority Data

Jan. 25, 2012 (GB) ..... 1201214.2

(51) Int. Cl.
*E21B 17/00* (2006.01)
*E21B 47/12* (2012.01)
*E21B 17/16* (2006.01)

(52) U.S. Cl.
CPC ..... *E21B 17/003* (2013.01); *E21B 17/16* (2013.01); *E21B 47/122* (2013.01)

(58) Field of Classification Search
CPC .... E21B 17/003; E21B 47/122; E21B 17/028; E21B 17/16; E21B 17/02; F16L 25/021; F16L 15/00; F16L 25/02
See application file for complete search history.

(56) References Cited

U.S. PATENT DOCUMENTS 2,090,822 A * 8/1937 Wright ..... E21B 17/16 175/294
3,327,794 A * 6/1967 Creel ..... E21B 10/627 175/412

(Continued)

FOREIGN PATENT DOCUMENTS

CA 2260307 9/1999
CA 2420402 8/2004

(Continued)

OTHER PUBLICATIONS

International Preliminary Report on Patentability and Written Opinion for PCT/GB2013/050146 (dated Jul. 29, 2014).

(Continued)

*Primary Examiner* — Daniel P Stephenson
(74) *Attorney, Agent, or Firm* — Klarquist Sparkman, LLP

(57) ABSTRACT

An insulating component for inclusion in a down hole drill string comprising a first part or connected group of parts, and a second part or group of parts. The first part or group of parts includes a first connection site and the second part or connected group of parts includes a second connection site. The insulating component also includes a first right-hand threaded connection located between the first connection site and the second connection site, and a second, left-hand threaded connection located between the first connection site and the second connection site. The first part or group of parts is electrically insulated from the second part or group of parts through insulating material provided between the first part or group of parts and the second part or group of parts, so that the first and second connection sites are electrically insulated from one another.

20 Claims, 4 Drawing Sheets

(56) References Cited

U.S. PATENT DOCUMENTS 3,829,816 A * 8/1974 Barry ..... E21B 17/028 285/414
4,496,174 A * 1/1985 McDonald ..... E21B 17/003 285/330
5,138,313 A * 8/1992 Barrington ..... E21B 17/003 175/40
5,474,334 A * 12/1995 Eppink ..... E21B 7/067 175/74
7,252,160 B2 * 8/2007 Dopf ..... E21B 17/003 166/242.6
7,605,716 B2 * 10/2009 Peter ..... E21B 17/028 166/378
9,261,208 B1 * 2/2016 Nations, Jr. ..... E21B 17/042
2003/0222409 A1 * 12/2003 Sivley, IV ..... E21B 17/042 277/616
2004/0104047 A1 * 6/2004 Peter ..... E21B 17/003 175/40
2004/0169367 A1 * 9/2004 Sutherland ..... E21B 17/003 285/53
2004/0206510 A1 * 10/2004 Fraser ..... E21B 17/028 166/378
2006/0201717 A1 * 9/2006 Cramer ..... E21B 17/028 175/320
2008/0060846 A1 * 3/2008 Belcher ..... E21B 17/042 175/25
2011/0031020 A1 * 2/2011 Cote ..... E21B 4/10 175/56
2011/0180273 A1 * 7/2011 Hughes ..... E21B 17/04 166/380
2011/0254695 A1 * 10/2011 Camwell ..... E21B 17/003 340/854.6
2011/0309949 A1 * 12/2011 Dopf ..... E21B 47/122 340/854.6
2013/0043874 A1 * 2/2013 Clark ..... E21B 10/00 324/369
2014/0050522 A1 * 2/2014 Slaughter, Jr. ..... F16D 1/033 403/342
2014/0265304 A1 * 9/2014 MacDonald ..... E21B 17/003 285/47
2015/0013963 A1 * 1/2015 McGarian ..... E21B 17/003 166/65.1
2015/0176341 A1 * 6/2015 Hughes ..... E21B 17/046 166/65.1
2015/0211307 A1 * 7/2015 Minosyan ..... E21B 17/003 166/66
2015/0292274 A1 * 10/2015 Logan ..... E21B 17/003 166/380
2015/0330155 A1 * 11/2015 Logan ..... E21B 17/003 166/380
2016/0032660 A1 * 2/2016 Logan ..... E21B 47/122 166/378
2016/0362940 A1 * 12/2016 Petrovic ..... E21B 17/003

FOREIGN PATENT DOCUMENTS

CA WO 2004076801 A1 * 9/2004 ..... E21B 17/003
EP 1898044 3/2008
GB 2498734 A * 7/2013 ..... E21B 17/003
WO WO82/02754 8/1982

OTHER PUBLICATIONS

International Search Report for PCT/GB2013/050146 (dated Mar. 13, 2014).
Gagemaker, Jim Douglas, "Prevent Rotary Shouldered Connection Failures," http://www.bowersgroup.co.uk/media/wysiwyg/prevent_rotary_shouldered_connection_failures.pdf (presented in Apr. 2011).

* cited by examiner

INSULATING COMPONENT

DESCRIPTION OF INVENTION

THIS INVENTION relates to an insulating component, and in particular concerns an insulating component to be included as a component in a drill string for sub-surface drilling, to form an electrically insulating break in the drill string.

When running a drill string into a well bore, and carrying out a drilling operation, it is usually desirable to be able to establish a communication link between one or more components in the drill string and the operators at the surface. Various techniques have been proposed for achieving this. One successful technique is the "earth signalling" approach, in which the drill string is considered to be a lossy coaxial cable extending to the surface. This approach generally requires an electromagnetic field to be generated in the well bore, and this in turn requires an insulating gap in the drill string.

Drill string components are generally fitted together end-to-end by standard threaded interfaces. It is therefore convenient to provide a modular insulating component, known as a "gap sub", which includes the standard interfaces and can simply be integrated into the drill string at the desired location.

One important design consideration is, however, that all of the components in the drill string must be able to withstand very high tension. This is because, at certain parts of the drilling operation, the drill string may effectively be suspended within the well bore from the surface, and the drill string must therefore be able to "hang" in free space (or in a fluid of the density of the fluid that will be encountered in the well bore) and support its own weight. Some components of the drill string, particularly the drilling components, can be extremely heavy. In addition to this, if the drill string becomes stuck or obstructed in the well bore, the drill string may be pulled upwardly from the surface. When this occurs, even greater tension will be placed on the components of the drill string.

Gap subs cannot simply be components formed from insulating material, therefore, as currently available insulating materials do not have the required mechanical properties. Various solutions have therefore been proposed which comprise components formed from robust material, such as steel, which are electrically insulated from one another but combine to form a component with the required mechanical properties.

It is an object of the present invention to provide an improved insulating component of this type.

Accordingly, one aspect of the present invention provides an insulating component for inclusion in a down hole drill string comprising: a first part or connected group of parts, the first part or group of parts including a first connection site at or near a first end of the component for connection to a first additional component in a drill string; a second part or connected group of parts, the second part or group of parts including a second connection site at or near a second end of the component for connection to a second additional component in a drill string; a first right-hand threaded connection located between the first connection site and the second connection site; and a second, left-hand threaded connection located between the first connection site and the second connection site, wherein the first part or group of parts is electrically insulated from the second part or group of parts through insulating material provided between the first part or group of parts and the second part or group of parts, so that the first and second connection sites are electrically insulated from one another.

Advantageously, if a rotational torque in one direction is applied between the first and second connection sites, this will tend to tighten one of the first and second connections, and if a rotational torque in the other direction is applied between the first and second connection sites, this will tend to tighten the other of the first and second connections.

Preferably, a compressive force can be applied to at least some of the insulating material through tightening one or both of the first and second threaded connections.

Conveniently, the first part or group of parts comprises a first end-piece, which comprises the first connection site.

Advantageously, the second part or group of parts comprises a second end-piece, which comprises the second connection site.

Preferably, one of the first and second threaded connections is formed between the first and second end-pieces.

Conveniently, the insulating component further comprises a mid-section which is positioned at least partly between the first and second end-pieces.

Advantageously, the mid-section forms at least a part of the external surface of the insulating component.

Preferably, one of the first and second threaded connections is formed between one of the first and second end-pieces and the mid-section.

Conveniently, the insulating component further comprises a stabilising component which is positioned at least partly between the first and second end-pieces.

Advantageously, the stabilising component is contained substantially wholly within the interior of the insulating component.

Preferably, one of the first and second threaded connections is formed between one of the first and second end-pieces and the stabilising component.

Conveniently, one of the first and second threaded connections is formed between the mid-section and the stabilising component.

Advantageously, one of the first and second threaded connections has insulating material provided between the threads of the connection.

Preferably, the other of the first and second threaded connections does not have insulating material provided between the threads of the connection.

Conveniently, the insulating material provided between the threads of the first or second connection comprises at least one insert which is provided in a substantially helical form and shaped to fit against at least part of the teeth of the threads.

Advantageously, two substantially helically-formed inserts are provided, one of the inserts being shaped to fit against one side of a plurality of teeth of the threads, and the other of the inserts being shaped to fit against the other side of the plurality of the teeth of the threads.

Preferably, the insulating component further comprises a third connection located between the first connection site and the second connection site that resists rotation between the two parts forming the connection.

Conveniently, the third connection comprises at least one elongate projection which is received in a corresponding elongate groove.

Advantageously, insulating material is provided between the two parts forming the third connection.

Preferably, in some or all instances where a pair of substantially planar faces meet when a threaded connection is tightened fully, these faces are preferably disposed at an angle to the perpendicular from a main central axis of the insulating component.

Conveniently, the insulating component comprises a first group of parts, wherein the first group of parts are in electrically-conductive contact with one another.

Advantageously, the insulating component comprises a second group of parts, wherein the second group of parts are in electrically-conductive contact with one another.

Another aspect of the present invention provides a drill string including an insulating component according to any preceding claim.

In order that the present invention may be more readily understood embodiments thereof will now be described, by way of example, with reference to the accompanying drawings, in which.

Figure 1:
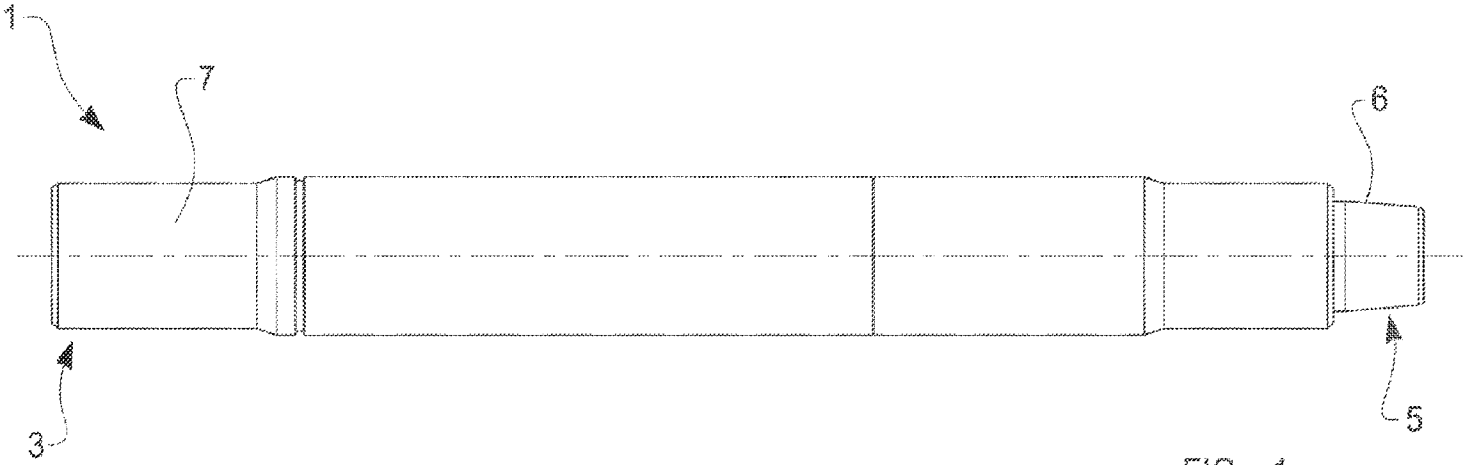
FIGS. 1 and 2 show a first insulating component embodying the present invention.
Figure 2:
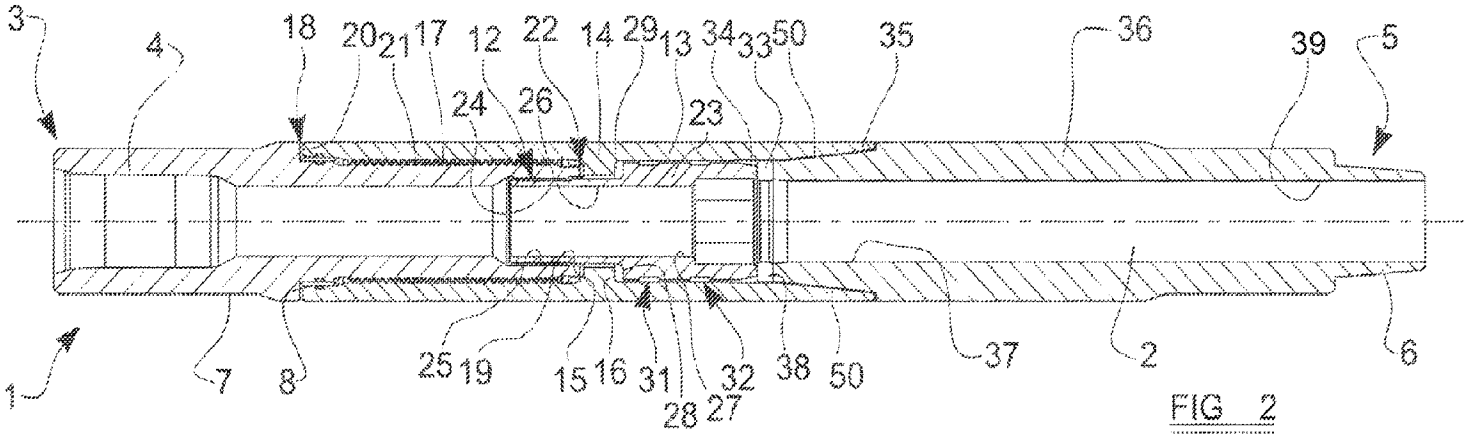

Referring firstly to FIGS. 1 and 2, a first gap sub 1 embodying the present invention is shown. FIG. 1 shows an exterior view of the gap sub 1, while FIG. 2 shows a cut-away cross-sectional view. The gap sub 1 generally takes the form of a elongate tubular component with a central bore 2 passing through the centre thereof. At a first end 3 the gap sub 1 comprises a tapered female threaded connection 4, and at a second end 5 there is a tapered male threaded connector 6. The male and female connections 4,6 are preferably of the standard form so that the gap sub 1 may be easily integrated into a drill string.

When the gap sub 1 is included in a drill string in its usual orientation, the first end 3 will be the top end and the second end 5 will be the bottom end.

The gap sub 1 comprises a first end-piece 7. The first end-piece 7 includes the female connector 4 at the first end 3 of the gap sub 1. The first end-piece 7 then reduces in width at a downward-facing shoulder 8, and terminates in an elongate sleeve 9. An outer surface of the sleeve 9 is formed to have a parallel right-hand screw thread 10. Preferably the screw thread 10 is extensive, comprising at least 20 turns (more preferably, at least 25 turns), although the number of turns required will depend upon the materials used. In general, if a larger tool must be carried as part of the drill string then more turns will be used, and if a smaller tool is employed then fewer turns will be used. However, it should be understood that this need not always be true, and the opposite could also be the case, for instance if the engaged thread shear area of the connection is varied. The mechanical strength of the materials used to form the components is also very important.

The majority of the inner surface 11 of the sleeve 9 is smooth, but at its distal end the inner surface comprises a narrowed portion with a parallel left-hand screw thread formed therein.

The gap sub 1 also includes a mid-section 13, which takes the form of an elongate sleeve having a generally smooth outer surface. Approximately midway along its length the mid-section 13 has a projection 14 which protrudes inwardly, taking the form of a continuous ring. The projection 14 presents upward-and-downward-facing shoulders 15,16. On one side of the projection 14, the interior surface of the mid-section 13 is formed with a generally parallel right-hand screw thread 17, which is adapted to cooperate with the screw thread 10 formed on the outer surface of the first end-piece 7. The mid-section 14 may therefore be screwed onto the first end-piece 7 until the top end 18 of the mid-section 13 abuts against the downward-facing shoulder 8 of the first end-piece 7, and the lower end 19 of the first end-piece 7 abuts against the upward-facing shoulder 15 of the projection 14 of the mid-section 13.

The first end-piece 7 and the mid-section 13 are electrically insulated from one another. In the embodiments shown, this insulation is achieved through inserts formed of an insulating material, such as a PEEK (polyether ether ketone) material. However, the skilled person will realise that any material having suitable insulting and mechanical properties may be used for this purpose. Isoval® 200 is another example of an insulating material that may be used. Different insulating materials may be used effectively in different situations. For instance, Isoval 200 is generally able to resist high compressive loads, but is not as robust against tensile loads. Ceramic materials, which perform in a similar manner, may also be used. For the different insulating components discussed in this specification, the skilled person will understand which material, or type of material, is suitable.

A first insulating insert 20 is generally L-shaped, and is positioned between the top end 20 of the mid-section 13 and the downward-facing shoulder 8 of the first end-piece 7, and also extends between the inner surface of the top end 18 of the mid-section 13, and the outer surface at the top end of the sleeve 9 of the first end-piece 7.

A second insulating insert 21 comprises a layer of insulating material which is positioned between the screw thread 10 presented on the outer surface of the sleeve 9 of the first end-piece 7, and the cooperating screw thread 17 presented on the inner surface at the top end of the mid-section 13. The second insulting insert 21 preferably extends to cover the side and top surfaces of each tooth of the screw threads 10, 17. In preferred embodiments, the second insert 21 may be formed from a piece of insulating material in an extended helical form, which is wrapped around or screwed onto the screw thread 10 of the first end-piece 7, so that it covers some or all of the teeth of the screw thread 10. Alternatively the second insert 21 may take the form of two pieces of insulating material in an extended helical form, which are wrapped around the screw thread 10 of the first end-piece 7, so that one piece lies against the upper side (or flank) of each tooth of the screw thread 10 and the other piece lies against the lower side of each tooth. The two pieces may abut each other, or lie close to each other, at the crests and troughs of the teeth. Three or more pieces may also be provided, as will be appreciated by the skilled reader.

A third insulating insert 22 is provided between the bottom end 19 of the sleeve 9 of the first end-piece 7 and the upward-facing shoulder 15 of the protrusion 14 of the mid-section 13.

It will therefore be understood that, when the mid-section 13 is screwed onto the sleeve 9 of the first end-piece 7, the first end-piece 7 and mid-section 13 are electrically insulated from one another through the three insulating inserts 20,21, 22. It will also be understood that, when the mid-section 13 is screwed onto the first end-piece 7, this will grip the insulating inserts 20,21,22 firmly in position, preventing them from moving during use of the gap sub 1. Preferably the insulating inserts will position the threads mid pitch (i.e. so each tooth is substantially the same distance from the two adjacent teeth, and is not pressed up against the next-lowest or next-highest tooth), eliminating any metal to metal contact. The insulating inserts 20,21,22 therefore do not need to provide any adhesive or bonding function to maintain the integrity of the gap sub 1. Nevertheless, it should be understood that the insulating inserts 20,21,22 may have adhesive properties, if this is required. In most embodiments, a "dope" will be added between the teeth of threaded connections, and this can act as a thread lubricant. The insulating material may therefore be chosen to have high friction properties, to prevent unwanted rotation during use of the gap sub 1.

Indeed, conventional thread dopes may be unsuitable for use in the gap sub 1, as they are often electrically conductive, and may comprise grease with suspended metal particles. If a dope cannot be used then the lubrication properties of the insulating material may have to be high.

The regions of insulating material 20,21,22 may be formed from sheets of material which are cut to appropriate sizes, or may be specifically moulded or otherwise shaped inserts.

The gap sub 1 also includes a stabilising component 23, which generally takes the form of a hollow, substantially cylindrical sleeve. A first (upper) end 24 of the stabilising component 23 has a relatively small outer diameter, and has a parallel left-hand screw thread 25 formed on its outer surface. A mid-section 26 is of approximately the same diameter as the first end 25, but has a substantially smooth outer surface.

A second (lower) end 27 is of greater external diameter, and an upward-facing shoulder 28 is formed between the mid-section 26 and the bottom end 27.

The stabilising component 23 may be screwed into the open lower end of the first end-piece 7, with the left-hand screw threads 12, 25 of the first end-piece 7 and the stabilising component 23 cooperating with one another. When the stabilising component 23 is fully engaged with the first end-piece 7, the mid-section 26 of the stabilising component 23 extends to cover the protrusion 14 of the mid-section 13, and the upward-facing shoulder 28 of the stabilising component 23 abuts against the downward-facing shoulder 16 of the protrusion 14.

The stabilising component 23 is electrically insulated from the mid-section 13. In the depicted embodiment, this insulation takes the form of an insulating ring 29 formed between the downward-facing shoulder 16 of the protrusion 14 of the mid-section 13 and the upward-facing shoulder 28 of the stabilising component 23. Further insulating rings 31,32 are positioned between the outer surface of the lower section 27 of the stabilising component 23 and the inner surface of the lowest part of the mid-section 13.

In this embodiment the stabilising component 23 is not electrically insulated, however, from the first end-piece 17.

A relatively large insulating ring 33 is positioned against the lower end 34 of the stabilising component 23.

The interior of the lower end of the lower part 35 of the mid-section 13 has a tapering screw thread 50 formed thereon.

A final major component of the gap sub 1 is a second end-piece 36, which again takes the form of a generally hollow, cylindrical sleeve. At its first (top) end 37 the second end-piece 36 has a tapering screw thread 38 formed therein, which cooperates with the screw thread 50 formed at the lower end 35 of the mid-section 13. The second end-piece 36 may therefore be screwed into the lower end 35 of the mid-section 13, until the top end 38 of the second end-piece 36 abuts against the insulating ring 33 which is positioned against the lower end 34 of the stabilising component 23. When fully installed, therefore, the second end-piece 36 helps to hold the stabilising component 23 in position, and (in combination with the insulating ring 33) prevents the stabilising component from "backing off" under rotation.

The main female connector 16 of the gap sub 1 is formed at the second (lower) end 39 of the second end-piece 36.

In the depicted embodiment no electrical insulation is provided between the mid-section 13 and the second end-piece 36, although this could be provided should circumstances dictate.

It will be understood that the effect of the insulating inserts and rings 20,21,22,29,31,32,33 is to form an electrically insulating barrier between, on the one hand, the first end-piece 7 and the stabilising component 23, and, on the other hand, the mid-section 13 and the second end-piece 36. The two main threaded contacts 4, 6 at the first and second ends 3, 5 of the gap sub 1 are therefore electrically insulated from one another.

The major components of the gap sub 1, namely the first and second end-pieces 7, 36, the mid-section 13 and the stabilising component 23 should be formed from a robust material such as steel. Preferably the material from which these components are formed is non-magnetic.

The gap sub 1 described above can be formed to have desirable mechanical properties.

Firstly, the threaded connection between the first end-piece 7 and the mid-section 13, which has insulating material 21 between the teeth of the threads, is formed to have a considerable length, and/or a large number of teeth. This is because a threaded connection with insulating material between the threads of the component will inevitably be weaker than a straightforward threaded connection between two robust components, and this allows tension forces applied to the gap sub 1 to be distributed among a large number of teeth.

In preferred embodiments the threaded connection between the first end-piece 7 and the mid-section 13 includes a sufficient length of thread to support the axial loads that are expected to be placed on the gap sub 1. It is also important to ensure that, when this threaded connection is tightened, the connection involves sufficient compressive stress that it will not separate under dynamic and bending loads which may arise due to rotation as the drill string passes through a "dog leg" or other bend in the well bore, or as a result of compressive forces on the drill string due to weight applied on the drilling assembly. The compressive stresses that can be borne by the insulating material within the threaded connection may be used as the limiting factor when determining the maximum make up torque (i.e. torque in a direction to tighten the connection) that can be applied to the connection.

Applying make up torque to the connection also applies make up torque to the male connector 6 at the second end 5 of the gap sub 1. As this occurs, the external shoulders of the gap sub 1 and the other component (to which the gap sub 1 is connected) contact one another and the male connector 6 will is pulled into tension. The ideal unit stress in the box or pin for certain applications may be 60,000 to 62,500 psi, subject to the connection mechanical strength. And so this governs the make up torque (i.e. tightening torque) that can be applied. One way to increase the make up torque is to form the female connector of the other component so that the distal end or nose of the male connector 6 abuts against an internal shoulder within the female connector. Make up torque may be increased by up to 40% or more using this technique.

Further, it is important that the positioning of the major components relative to one another does not change significantly during use of the gap sub 1, to avoid placing undue stresses on the insulating components, which is likely to cause the insulating components to degrade and fail.

As discussed above, components in a drill string are normally connected end-to-end by a series of standardised right-hand threaded connections. In use it is often necessary to rotate a drill string about its axis, and in practice this is always done in a clockwise sense, that would tend to tighten the threaded connections between the components. Turning the drill string anti-clockwise, which might loosen the connections, is generally avoided wherever possible.

However, in use of a drill string knocks, vibration and local forces, dynamics, may cause some anti-clockwise rotation of at least part of the drill string. However, the fact that the first end-piece 7 is connected to the mid-section 13 by a right-hand threaded connection, and the stabilising component 23 is connected to the first end-piece 7 via a left-hand threaded connection, means that the combination of the first end-piece 7, the mid-section 13 and the stabilising component 23 will retain their relative positions with a very high degree of accuracy whether the gap sub 1 is subjected to clockwise or anti-clockwise rotational forces along its length.

Of course, it should be understood that the connection between the first end-piece 7 and the mid-section 13, and/or the connection between the second end-piece and the mid-section 13, could be through a left-hand threaded connection, with the stabilising component 23 being connected to the first end-piece 7 via a right-hand threaded connection (this arrangement would be suitable for a left-hand string). What is important is that the respective threaded connections are formed in opposite senses.

Moreover, while the gap sub 1 has both right- and left-handed threaded connections, it is preferred that only one of these threaded connections has insulating material positioned between the two components.

Figure 3:
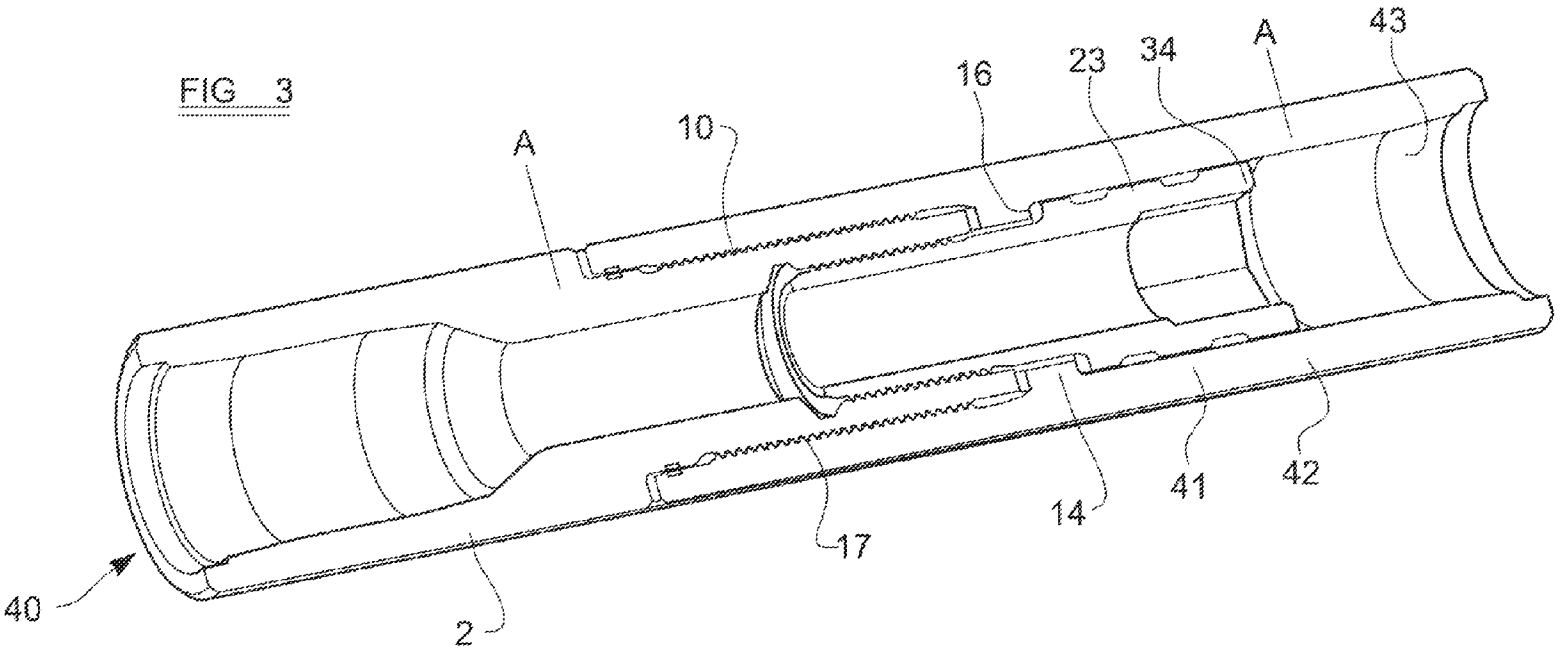
FIGS. 3 and 4 show a second insulating component embodying the present invention.

FIG. 3 shows an alternative embodiment of the invention, which shares many components with the first embodiment discussed above.

FIG. 3 shows a second gap sub 40 having a first end-piece 7 which is identical to that discussed above. However, the second gap sub 40 includes a second end-piece 41 which effectively comprises a combination of the midsection 13 and second end-piece 36 of the first embodiment 1 discussed above. The second end-piece 41 of the second gap sub 40 takes the form of a hollow cylindrical sleeve having an inward-facing protrusion 14 roughly midway along its length. The inner surface of the upper side of the second endpiece 41 comprise a parallel right-hand screw thread 17 which is adapted to cooperate with the screw thread 10 formed on the outer surface of the first end-piece 7.

The lower side 42 of the second end-piece 41 has a generally smooth inner surface, and the second end-piece 42 terminates in a standard female threaded connection 43.

A stabilising component 23, effectively identical to that discussed above in relation to first embodiment, is screwed into the open lower end of the first end-piece 7 via a left-handed, parallel threaded connection, and the upward-facing shoulder 28 of the stabilising component 23 abuts against the downward-facing shoulder 16 of the projection 14 of the second end-piece 42.

It will be understood that the second gap sub 40 does not have a component which abuts against the lower end 34 of the stabilising component 23. However, the second gap sub 40 benefits from a simplified construction, having only three major components.

As with the first embodiment, the second gap sub 40 includes an insulating barrier between, on the one hand, the first end-piece 7 and the stabilising component 23, and, on the other hand, the second end-piece 41.

Figure 4:
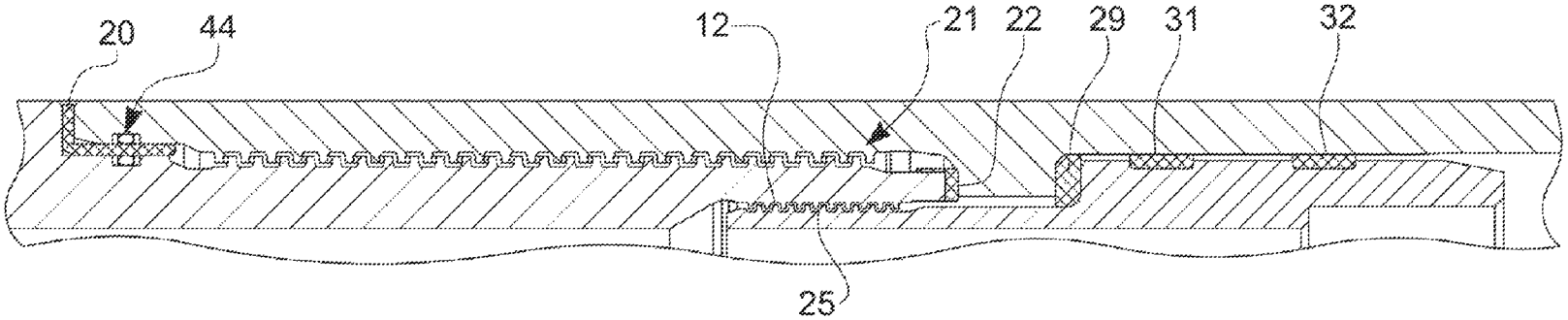

FIG. 4 shows a close-up view of the second gap sub 40. This is taken between the two points indicated by "A" in FIG. 3. In FIG. 4, the insulating components 20,21,22,29, 31,32 can be clearly seen.

FIG. 4 also shows a pair of seals 44, which are provided on either side of the part of the L-shaped insulating insert 20.

Figure 5:
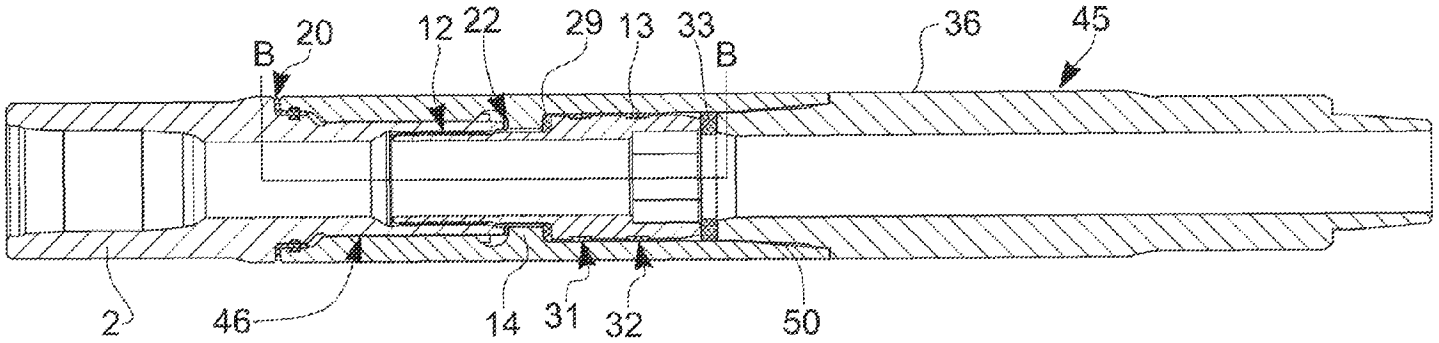
FIGS. 5 to 7 show a third insulating component embodying the present invention.
Figure 6:
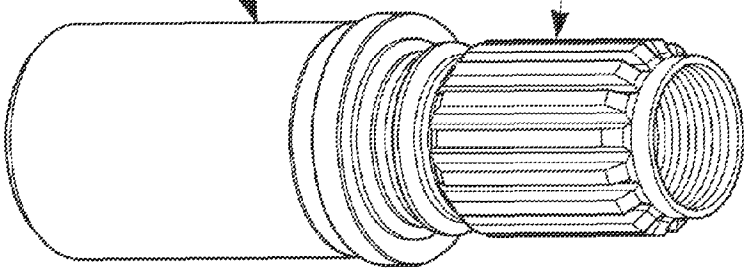
Figure 7:
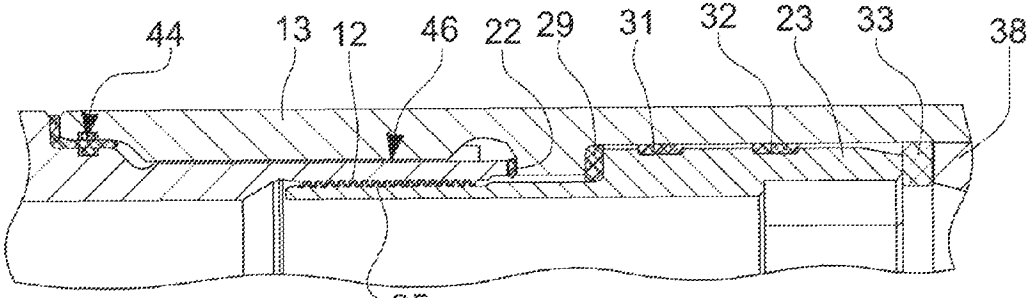

FIGS. 5 to 7 show a third gap sub 45 embodying the present invention. First it can be seen in the cut-away view shown in FIG. 5, the third gap sub 45 shares most of its components with the first gap sub 1 described above. The principal difference is that, at the interface between the outer surface of the sleeve 9 of the first end-piece 7, and the inner surface of the upper end of the mid-section 13, there is no threaded connection. Instead, these components have a series of cooperating splines which slide into interleaved relation with one another, and have a layer of insulating material 46 disposed therebetween. The first end-piece 7 and the mid-section 13 are therefore rotationally linked together through the interaction of the splines.

FIG. 6 shows the first end-piece 7 in isolation, and the splines 47 can clearly be seen.

FIG. 7 shows a close-up view of the third gap sub 45, taken between the two points indicated by "B" in FIG. 5.

The interconnection of the splines 47 of the third gap sub 45 makes the third gap sub 45 very robust under rotational or torsional forces. It will be understood that the third gap sub 45 is also robust against loosening due to anti-clockwise rotation of the drill string. The first end-piece 7 and the mid-section 13 together form a rotationally-connected unit. This unit is connected to the second end-piece 36 via a right-hand threaded connection, and to the stabilising component 23 via a left-hand threaded connection.

Figure 8:
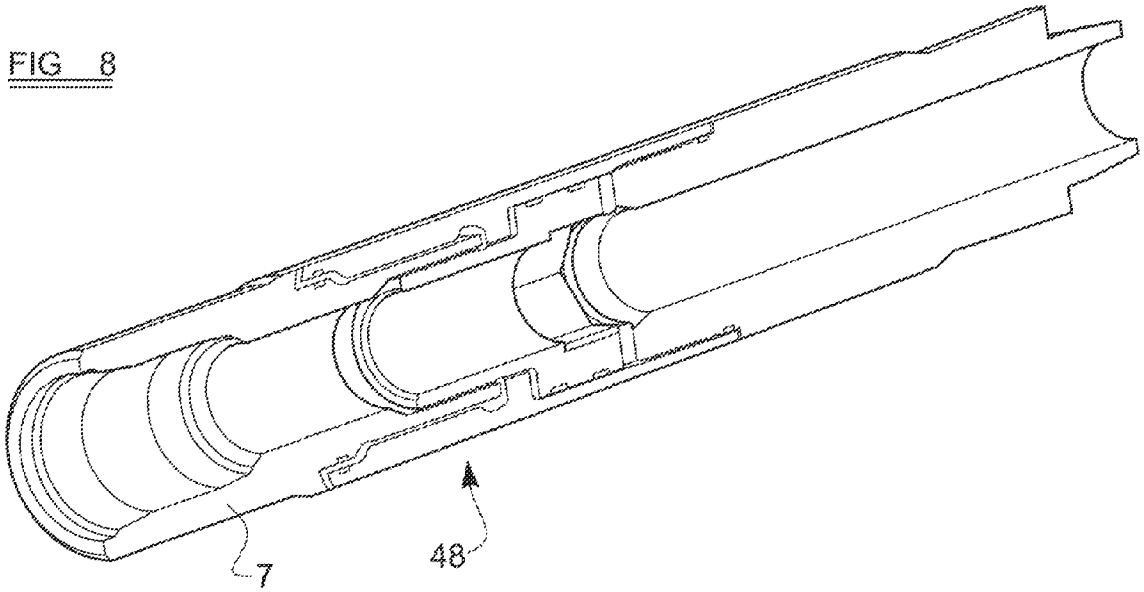
FIGS. 8 and 9 show a fourth insulating component embodying the present invention.
Figure 9:
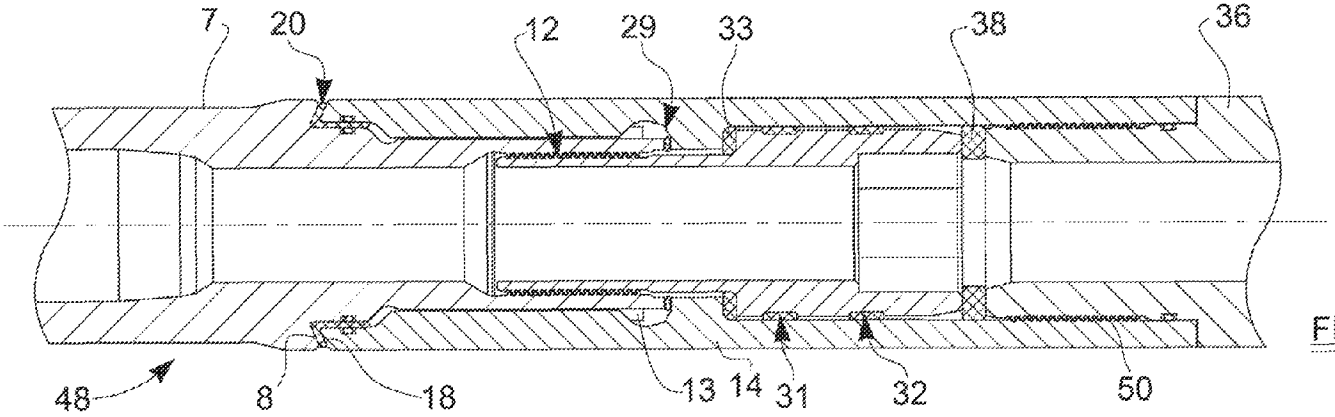

FIGS. 8 and 9 show a fourth gap sub 48 embodying the present invention. The fourth gap sub 48 is similar to the third gap sub 45, with one important difference being that the threaded connection between the lower end of the mid-section 13 and the upper end of the second end-piece 36 is a parallel threaded connection, rather than a tapered threaded connection. This allows the diameter of the internal bore 2 of the gap sub 48 to be maximised. Parallel threaded connections may also be generally preferred to tapered connections, as problems are often encountered with tapered connections. These problems are discussed "Prevent Rotary Shouldered Connection Failures", by Jim Douglas Gagemaker (presented in April 2011), and the skilled person will be aware of these issues.

It should also be noted that the downward-facing shoulder 8 of the first end-piece 7 is angled, so that it slopes away from the first end 3 of the gap sub 1 as it progresses radially outwardly. The top end 18 of the mid-section 13 is correspondingly angled. The first insulating insert 20 is shaped to be able to fit snugly into the gap between these components.

The angling of the faces making up this connection helps to prevent the female connector 4 from expanding if excessive torque is applied to the gap sub 1, and to provide increased surface area for shoulder area when make up torque is applied to the gap sub 1.

The interface between the bottom end of the mid-section 13 and the second end-piece 36 is similarly angled, although in this case the faces are angled away from the second end 5 of the gap sub 1 as they progress radially outwardly.

In preferred embodiments, in some or all instances where a pair of substantially planar faces (e.g. shoulders) meet when a threaded connection is tightened fully, these faces are preferably disposed at an angle to the perpendicular from the main central axis of the gap sub 1, and also are preferably substantially parallel with one another.

FIG. 9 shows a close-up view of the internal components of the fourth gap sub 48.

In the embodiments above, standard threaded connections are described. However, it should be understood that any suitable types of threaded connection may be used, for instance "two start" (or multi start) threads. It should also be understood that there are many diverse thread forms, and any suitable thread form may be used. For instance, the invention may be used with square form, V form or radiused teeth, teeth comprising any combination of these forms, or any other type of teeth.

It will be understood that embodiments of the present invention allow a robust gap sub which can effectively form an electrically insulating gap between other components of a drill string, yet which will readily be able to withstand very large tensile, rotational and/or torsional forces, and maintain its functionality and integrity under demanding down-hole conditions.

When used in this specification and claims, the terms "comprises" and "comprising" and variations thereof mean that the specified features, steps or integers are included. The terms are not to be interpreted to exclude the presence of other features, steps or components.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof.

The invention claimed is:

1. An insulating component for inclusion in a down hole drill string comprising:

a first part or connected group of parts, the first part or group of parts including a first end-piece that comprises a first connection site at or near a first end of the insulating component for connection to a first additional component in a drill string, a second part or connected group of parts, the second part or group of parts including a second end-piece that comprises a second connection site at or near a second end of the insulating component for connection to a second additional component in a drill string;

a first right-hand threaded connection located between the first connection site and the second connection site;

a second, left-hand threaded connection located between the first connection site and the second connection site; and a stabilising component which is positioned at least partly between the first and second end-pieces, wherein one of the first and second threaded connections is formed between a mid-section and the stabilising component, wherein:

the first part or group of parts is electrically insulated from the second part or group of parts through insulating material provided between the first part or group of parts and the second part or group of parts, so that the first and second connection sites are electrically insulated from one another.

2. An insulating component according to claim 1 wherein, if a first rotational torque in a first direction is applied between the first and second connection sites, the first rotational torque will tend to tighten one of the first and second connections, and if a second rotational torque in a second direction opposite the first direction is applied between the first and second connection sites, the second torque will tend to tighten the other of the first and second connections.

3. An insulating component according to claim 1 wherein a compressive force can be applied to at least some of the insulating material through tightening one or both of the first and second threaded connections.

4. An insulating component according to claim 1, wherein one of the first and second threaded connections is formed between the first and second end-pieces.

5. An insulating component according to claim 1, wherein the mid-section is positioned at least partly between the first and second end-pieces.

6. An insulating component according to claim 5, wherein the mid-section forms at least a part of the external surface of the insulating component.

7. An insulating component according to claim 5, wherein one of the first and second threaded connections is formed between one of the first and second end-pieces and the mid-section.

8. An insulating component according to claim 1, wherein the stabilising component is contained substantially wholly within the interior of the insulating component.

9. An insulating component according to claim 1, wherein one of the first and second threaded connections is formed between one of the first and second end-pieces and the stabilising component.

10. An insulating component according to claim 1, wherein one of the first and second threaded connections has insulating material provided between the threads of the connection.

11. An insulating component according to claim 10, wherein the other of the first and second threaded connections does not have insulating material provided between the threads of the connection.

12. An insulating component according to claim 10, wherein the insulating material provided between the threads of the first or second connection comprises at least one insert which is provided in a substantially helical form and shaped to fit against at least part of the teeth of the threads.

13. An insulating component according to claim 12, wherein two substantially helically-formed inserts are provided, one of the inserts being shaped to fit against one side of a plurality of teeth of the threads, and the other of the inserts being shaped to fit against the other side of the plurality of the teeth of the threads.

14. An insulating component according to claim 1, further comprising a third connection located between the first connection site and the second connection site that resists rotation between the first part or group of parts and the second part or group of parts forming the connection.

15. An insulating component according to claim 14, wherein the third connection comprises at least one elongate projection which is received in a corresponding elongate groove.

16. An insulating component according to claim 14, wherein insulating material is provided between two parts forming the third connection.

17. An insulating component according to claim 1, wherein in some or all instances where a pair of substantially planar faces meet when a threaded connection is tightened fully, the faces are disposed at an angle to the perpendicular from a main central axis of the insulating component.

18. An insulating component according to claim 1, comprising a first group of parts, wherein the first group of parts are in electrically-conductive contact with one another.

19. An insulating component according to claim 1, comprising a second group of parts, wherein the second group of parts are in electrically-conductive contact with one another.

20. An insulating component according to claim 1, wherein the first connection site and the second connection site comprise threaded connections having a same sense.

* * * * *